US007048266B2

(12) United States Patent
Starr

(10) Patent No.: US 7,048,266 B2
(45) Date of Patent: May 23, 2006

(54) DEVICE AND METHOD FOR TEMPORARILY FASTENING A PLURALITY OF WORKPIECES IN RESPONSE TO THE INTRODUCTION OF PRESSURIZED FLUID

(75) Inventor: Donald G. Starr, San Pedro, CA (US)

(73) Assignee: Monogram Aerospace Fasteners, Inc., Los Angeles, CA (US)

( * ) Notice: Subject to any disclaimer, the term of this patent is extended or adjusted under 35 U.S.C. 154(b) by 156 days.

(21) Appl. No.: 10/273,437

(22) Filed: Oct. 17, 2002

(65) Prior Publication Data

US 2004/0075206 A1 Apr. 22, 2004

(51) Int. Cl.
*B66F 15/00* (2006.01)

(52) U.S. Cl. ..... 269/25; 254/18; 254/48.1

(58) Field of Classification Search ..... 269/25, 269/20, 32, 48.2, 48.1; 29/252, 253; 81/59.1
See application file for complete search history.

(56) References Cited

U.S. PATENT DOCUMENTS 2,463,731 A * 3/1949 Whalen ..... 269/48.4
2,775,155 A * 12/1956 Tompkins et al. ..... 269/48.3
2,909,949 A 10/1959 Winslow
3,162,072 A 12/1964 Stewart
3,164,283 A 1/1965 Olson
3,263,320 A 8/1966 Jones
3,414,253 A * 12/1968 Mewse ..... 269/47
3,424,050 A 1/1969 Burrow et al.
3,599,958 A 8/1971 Schindler
3,763,541 A 10/1973 Jaffee
4,488,713 A * 12/1984 Kosmal et al. ..... 269/25
4,709,843 A 12/1987 Wagenknecht et al.
4,787,274 A 11/1988 Belanger
4,872,332 A 10/1989 Potzas
5,048,805 A 9/1991 Wiseman
5,240,361 A 8/1993 Armstrong et al.

OTHER PUBLICATIONS

Catalog (An Pages) Wedgelock Temporary Fastening Systems & Drilling Aids (Monogram Aerospace Fasteners–)Los Angeles, CA)-1998).

* cited by examiner

*Primary Examiner*—Lee D. Wilson
(74) *Attorney, Agent, or Firm*—McDonald Hopkins Co., LPA; Robert H. Earp, III; Todd A. Benni

(57) ABSTRACT

Disclosed is a fastener and method for temporarily fastening a plurality of workpieces. The fastener uses pressurized fluid to facilitate the actuating clamping motion of a temporary fastener as opposed to conventional mechanically actuation devices. The fastener of the present invention generally comprises a housing, a spreader member connected to the housing, a piston located within said housing and capable of movement therein in response to the introduction of pressurized fluid within the housing, and a pair of expandable flexible fingers connected at one end to the piston and extending outside the housing where fluid-actuated movement of the piston causes the fingers to partially retract within the housing and wedge within the aligned apertures of the workpieces to temporarily clamp the workpieces together. A check valve within the piston assembly prevents the escape of pressurized fluid from within the fluid pressure chamber when the source of pressurized fluid is removed. The temporary fastener provides an instant load-release feature so that manual removal of the fastener is provided.

15 Claims, 2 Drawing Sheets

DEVICE AND METHOD FOR TEMPORARILY FASTENING A PLURALITY OF WORKPIECES IN RESPONSE TO THE INTRODUCTION OF PRESSURIZED FLUID

FIELD OF INVENTION

The present invention relates to a device and method for temporarily fastening a plurality of workpieces together, and more particularly, to a device and method for temporarily fastening a plurality of workpieces in response to the introduction of pressurized fluid.

BACKGROUND OF THE INVENTION

Mechanical temporary fasteners are used in a number of industries to temporarily hold workpieces or sheets of material together prior to fastening. Particularly, mechanical temporary fasteners are used extensively in the aircraft manufacturing industry to precisely join assorted structural members for final assembly.

One such typical temporary fastener includes elongated, slidable, needle-like structures or fingers with enlarged heads that are inserted into aligned apertures located in the sheet layers to be fastened. Clamping pressure is applied to the layers by turning a threaded sleeve that retracts the splayed fingers over a spreader located between the fingers. The sheets are secured by forced separation of the enlarged heads thereby causing a wedged seal within the aperture. Such fasteners, in theory, develop a proportionate clamping force in response to the torque applied to the screw threads. In actual practice, that relationship is often catastrophically altered by other variables such as friction, foreign materials, installation speed, etc. In practice, it is difficult or nearly impossible to utilize a mechanical fastener to obtain a consistent or desired clamping pressure or load to the structures.

Because clamping pressure is relative to the degree of torque applied to the fastener, too much torque may cause an increased clamping pressure that may damage the layers while too little torque may provide inadequate pressure resulting in poor fastening. For example, the "back-side" clamping feature (the protuberances on the fingers) has an extremely small foot print area since it must fit through aligned apertures. When clamping force is excessive it may cause unacceptable damage to the "back-side" component material where contact is made by the clamping feature. A lack of clamping pressure control is inherent in the design of such mechanical temporary fasteners and may result in unacceptable damage to structural materials.

Further, a popular version of the prior art temporary fastener described above has its use limited to clamping work pieces that are dry. When the work pieces are "wet" (when the work pieces have a viscous fluid such as an adhesive or a dissimilar metals barrier medium therebetween) the clamp-up is likely to disappear due to a modest migration of that fluid via hydraulic reaction to clamping force. A companion to that fastener device is designed with a mechanical spring to compensate for that migration. The enhanced merits of both designs are inherent features of the present invention. Therefore, there is a need in the art to provide a temporary fastener that enables a user to more precisely control the amount of clamping force developed.

Another type of typical temporary fastener achieves its clamping action by spring biasing the fingers having enlarged heads toward the clamp body over a spreader bar where the fingers are normally withdrawn into the clamp body. The clamp is operable by overcoming the spring bias and extending the needles over and beyond a spreader bar, which allows the flexible head ends to be moved toward each other for insertion into aligned holes. The clamp body is subsequently brought into proximity to the workpiece surface, either by the operator or by reaction to the spring pulling the needle members into the clamp body during needle member withdrawal through the clamp body. The force applied to overcome the spring bias is removed and the spring urges the needles within the clamp body and over the spreader bar to force the needle ends to move apart to engage the inner panel and inner surface, thus securing the workpieces between the clamp body and the enlarged ends of the needles. Needless to say, the maximum clamping force that the clamp exerts is in some cases limited by the spring force, that is the product of the spring constant and the spring displacement. This spring force may not be adequate to clamp the two sheets together.

Regardless of which prior art fastener is used, the time spent installing and removing such fasteners can represent a significant fraction of production and labor costs. Due to the inherently inadequate clamping pressure provided by these traditional mechanical fasteners, skilled persons must install and remove such fasteners. Therefore, automating the installation and removal of mechanical fasteners appears unlikely given the current mechanical temporary fastener designs. Therefore, there is a need in the art to provide a fastener that can provide adequate clamping pressure and that can be installed and removed in an automated system, i.e. installation and removal by robot or other automated process.

The present invention addresses these and other needs as described below.

SUMMARY OF THE INVENTION

It is an object of the present invention to provide a temporary fastener that can provide accurate and repeatable clamping pressure (i.e. load) while minimizing mechanical or operator error.

It is a further object of the present invention to provide a temporary fastener that utilizes a pressurized fluid to operate the fastener, wherein such pneumatic or hydraulic pressure is adjustable, repeatable, and relatively inexpensive to operate.

It is also an object of the present invention to provide a temporary fastener that is easier to install and remove over the prior art.

It is also an object of the present invention to provide a temporary fastener capable of installation and removal by an automated process, such as by a robot or other automated processes.

These and other objects are provided by a fastener and method for temporarily fastening a plurality of workpieces disclosed herein. The fastener of the present invention uses pressurized fluid to facilitate the actuating clamping motion of a temporary fastener as opposed to conventional, mechanical, actuation devices. The fastener of the present invention facilitates quick and reliable controlled temporary positioning, clamping, and securing of two or more panel structures, with or without inter layer sealant or adhesive, for subsequent drilling and fastener installation. The mechanical motion is replaced with a pressure-actuated mechanism that instantly draws the mating components together creating the clamping function. Removal is accomplished by simply pushing a pressure relief valve instead of installing and operating a mechanical removal tool. For installation using adhesives, some type of mechanical removal tool or automated device may be required.

The fastener of the present invention generally comprises a housing, a spreader member connected to the housing, a piston located within the housing and capable of movement therein in response to the introduction of fluid pressure within the housing, and a pair of expandable flexible fingers connected at one end to the piston and extending outside the housing where fluid-pressure actuated movement of the piston causes the fingers to partially retract within said housing and wedge within the aligned apertures of the workpieces to temporarily clamp the workpieces together. A check valve within the piston assembly prevents the escape of pressurized fluid from within the fluid pressure chamber when the source of pressurized fluid is removed. Thus, the temporary fastener may be actuated and removed from the installation tool. The temporary fastener provides an instant load-release feature so that manual release of the pressurized fluid may permit removal of the fastener.

In effect, this invention uses a hydraulic or pneumatic system instead of a mechanical spring. The force applied by a mechanical spring will decay from 100% to zero as the spring expands from its solid height to fully relaxed. The force applied by a hydraulic or pneumatic system will decay only a slight amount in that same physical distance. For example, the force decay of a mechanical spring with a solid length of 0.540" and a relaxed length of 0.625" will be to 100% over that difference (0.085"). In the same case, the force decay of a pneumatic system will be only to 15%.

The present invention will be more fully described in the following written description with reference to the accompanying drawings.

DETAILED DESCRIPTION OF THE INVENTION

Figure 1:
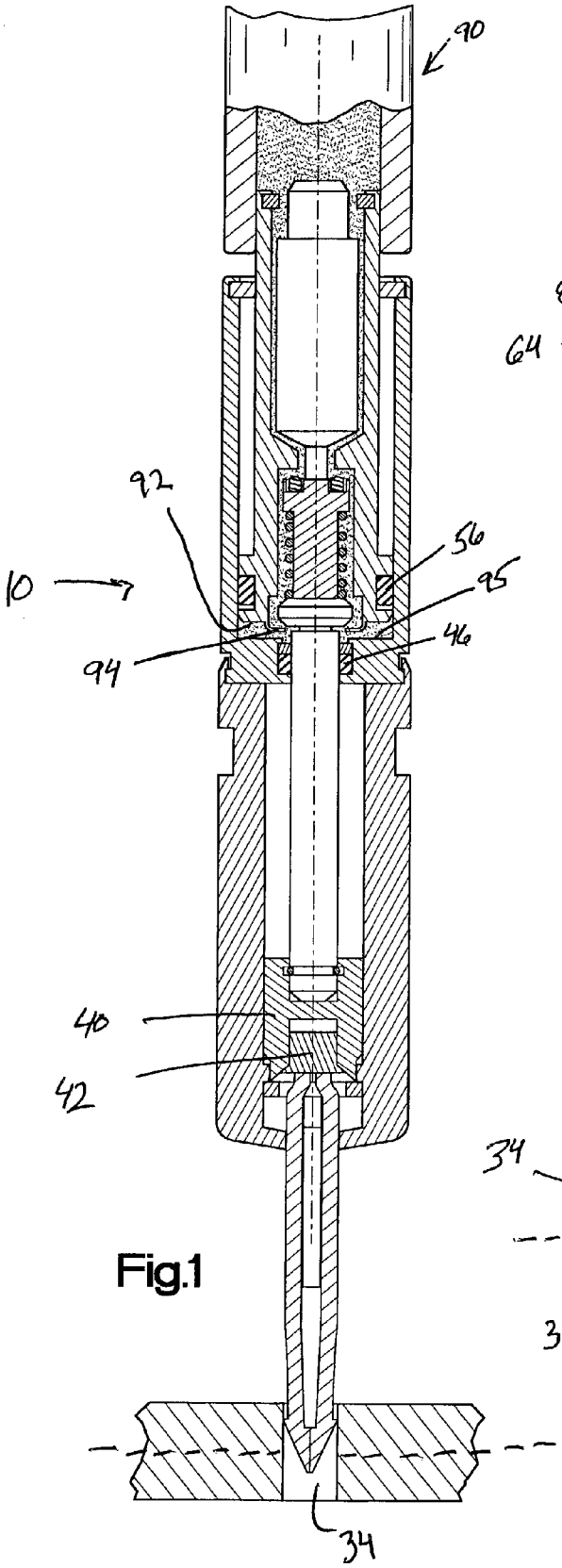
FIG. 1 is a typical cross-section view of the temporary fastener of the present invention during insertion within the aligned apertures of a workpiece.

While a particular form of the invention is illustrated and described, it will be apparent that various modifications can be made without departing from the spirit and scope of the invention. Accordingly, it is not intended that the invention be limited, except as by the appended claims.

As shown in the exemplary drawings, a temporary fastener, designated 10, generally comprises a housing 12, a spreader member 14 connected to the housing 12, a piston 16 located in and capable of movement within the housing 12 in response to the introduction of pressurized fluid, and a pair of expandable flexible fingers 18 connected at one end to the piston 16. The fastener 10 is operable by the upload of pressurized fluid into the fastener 10 to develop a force on the piston 16 to provide a clamping force. Although any fluid under pressure, i.e. gas (pneumatic) or liquid (hydraulic), could be used, the preferred embodiment of the present invention utilizes pressurized air to develop the clamping force. Therefore, for the sake of simplicity, the description herein will further describe the invention as utilizing pressurized air, although the invention and appended claims contemplate the use of any other suitable pressurized fluid. Any adjustment in the amount of pressurized fluid produces a proportionate adjustment in clamping force. Material damage can be eliminated because the actuating pressure can be accurately adjusted and maintained. Friction, leverage, and other factors that contribute to a poor relationship of driving force (torque) and clamping force in mechanically operated prior designs are absent in the present fastener design.

Figure 3:
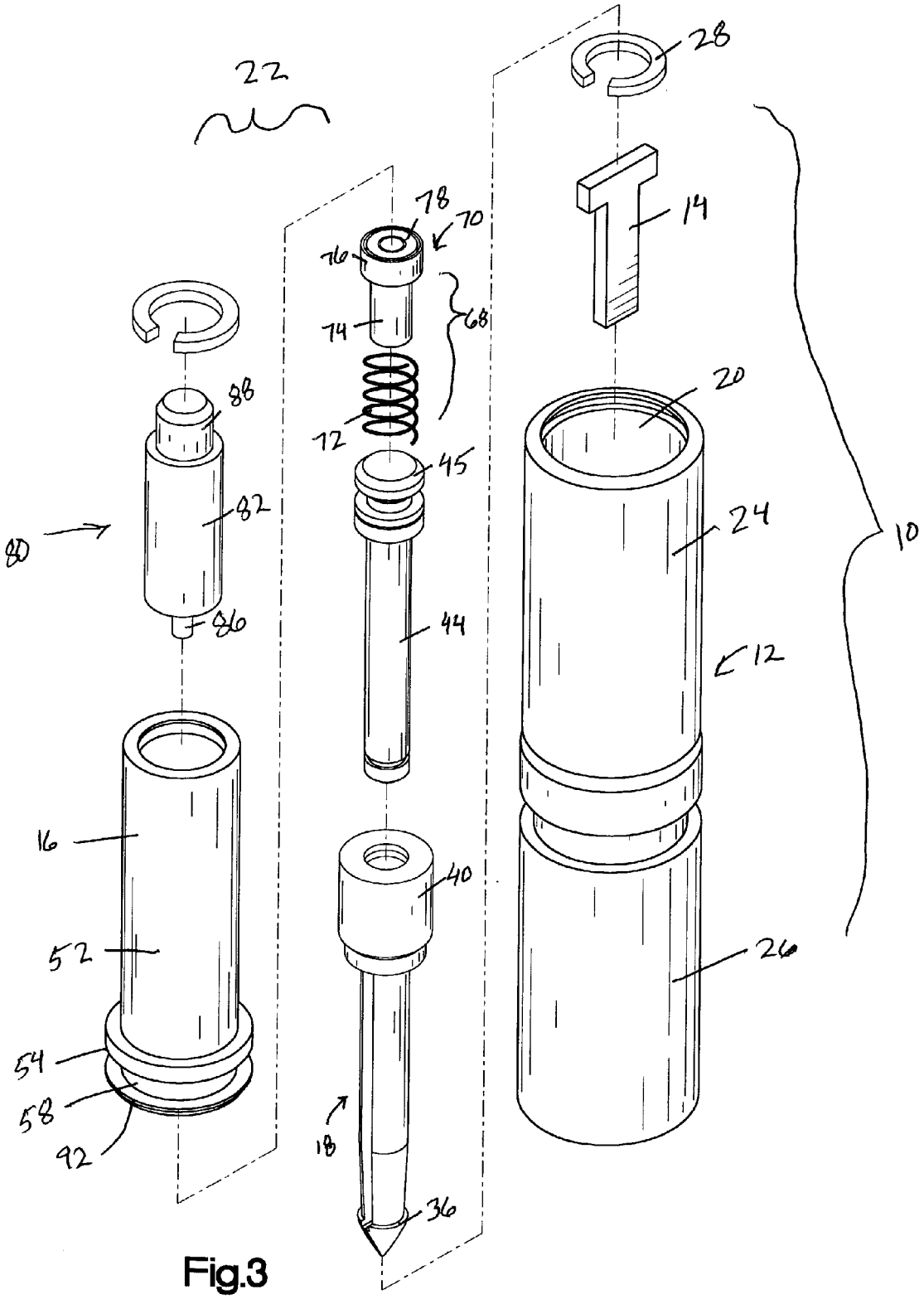
FIG. 3 is a typical exploded view of the temporary fastener showing the components thereof.

With particular reference to FIG. 3, the fastener 10 comprises a generally cylindrical housing 12 having a bore 20 therethrough for retaining the piston assembly 22 for axial movement therein. Although a single member housing could be utilized, the housing 12 of the present invention comprises an upper housing portion 24 and a lower housing portion 26 connected to each other during assembly of the fastener 10. Spreader member 14 is mounted at the distal end of the lower housing portion 26 within bore 20. Spreader member 14 is held in axial position within bore 20 by fixed washer 28.

Figure 2:
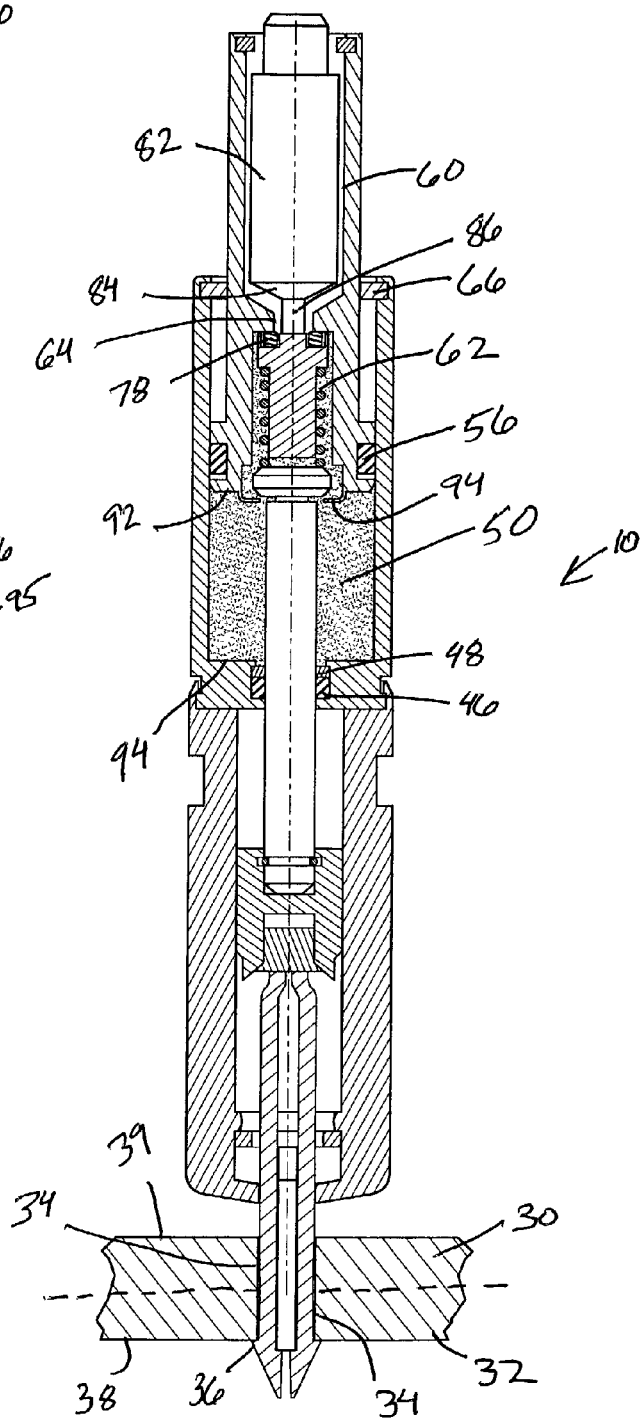
FIG. 2 is a typical cross-sectional view of the temporary fastener of FIG. 1 during actuation so as to set the fastener in its clamping position.

The piston assembly 22 is moveable within housing 12 between a first position, shown in FIG. 1, where fingers 18 fully extend outside the housing 12 and a second position, shown in FIG. 2, wherein fingers 18 are retracted within the housing 12 and over the spreader member 14 to clamp together workpiecess 30,32. Piston assembly 22 is moveable within the housing 12 by the introduction of a pressurized fluid. While any pressurized fluid could be used, the present invention preferably utilizes pressurize air to actuate the fastener 10.

As shown in FIG. 3, piston assembly 22 includes a pair of fingers 18 that are generally biased toward each other and capable of insertion through the aligned apertures 34 in workpieces 30,32. Fingers 18 also include mutually opposed protuberances 36 at the distal ends thereof. Therefore, upon retraction and separation of the fingers 18 over spreader member 14, protuberances 36 engage the inner surface 38 of the inner workpiece 32 to prevent the removal of the fingers 18 from within the aligned apertures 34.

Fingers 18 are connected to a coupler member 40, preferably by weld 42, but could be connected by soldering, crimping, mechanical wedges, or any other suitable connection. Connected at the opposite end of coupler member 40 is a generally cylindrical shaft 44 that extends axially within housing 12 and has a shaft head 45 at its outer end. As best shown in FIGS. 1 and 2, shaft 44 extends from the lower housing portion 26 to the upper housing portion 24 through shaft o-ring 46. Shaft o-ring 46 is held in place within the upper housing portion 24 by o-ring stop 48 wherein an air-tight seal is maintained between the shaft o-ring 46 and the shaft 44 during air pressure actuation and axial movement of the shaft 44. Therefore, a fluid pressure chamber 50 is defined in the upper housing portion 24 to translate motion to the piston assembly 22 to cause fingers 18 to retract within the housing 12 and create a clamping force.

Slidably held within the upper housing 24 is piston 16. Piston 16 comprises a generally cylindrical portion 52 having a larger diameter head 54 at its inner end. A seal 56 located within a groove 58 around the head 54 creates a fluid-tight seal between the piston 16 and the housing 12. Piston 16 includes an upper bore 60 and a lower bore 62 connected by a smaller diameter connecting bore 64. Lower bore 62 has a diameter large enough to hold the shaft head 45. Piston 16 also includes an inwardly extending circular flange 94 that maintains piston head 45 within the lower bore 62 and translates motion from piston 16 to the shaft 44. Piston 16 is axially moveable within bore 20 of the upper housing portion 24 and is further supported therein by washer 66 located at the upper end of the housing 12.

A check valve assembly 68 is located within the lower bore 62 of the piston 16 and comprises a check valve body 70 inserted within a compression spring 72 that engages the shaft head 45. Check valve body 70 comprises a generally cylindrical body 74 having an enlarged diameter head 76 at its upper end. A seal 78 is located within the valve piston head 76 to provide a fluid-tight seal when the check valve body 70 is urged into engagement against the inner wall of the lower piston bore 62.

A plunger 80 is located within the upper bore 60 in piston 16 and comprises a generally cylindrical body 82 have a tapered portion 84 at its inner end and a check valve engaging tip 86 extending therefrom. The upper portion of the plunger 80 includes a smaller diameter plunger button 88 that extends outwardly from within the upper bore 60 to provide access to the plunger 80. Upon depression of the plunger button 88, the plunger tip 86 depresses the check valve body 70 that is normally spring-biased in the closed position. Depression of the check valve body 70 enables the release of air pressure from within the fluid pressure chamber 50.

In operation, fastener 10 may be inserted into an installation tool or inserted by hand and actuated by an actuation tool. As explained herein, the drawings show the fastener inserted into an installation tool and then inserted into the aligned apertures of a plurality of workpieces for clamping them together. It is noted that eh fastener of the present invention may be utilized to clamp work pieces that are either "wet" or "dry."

The fastener 10 is operable by extending the fingers 18 to a position over and beyond the spreader member 14 a shown in FIG. 1. With the fingers 18 extended beyond the spreader member 14 and the fastener 10 held within the installation tool 90, the flexible finger protuberances 36 bias toward each other for insertion into the aligned apertures 34 of inner workpiece 32 and outer workpiece 30. As the fingers 18 are inserted within the aligned apertures 34, the fastener housing 12 is subsequently brought into proximity to the outer workpiece surface 39 either by the operator or by reaction to the fingers 18 pulling the fastener housing 12.

The installation tool 90, connected to the outer diameter of piston 16, includes a source of pressurized air. With the installation tool 90 properly connected to the piston 16 and the extended flexible fingers 18 inserted into the aligned apertures 34 of workpieces 30,32, as shown in FIG. 1, actuation of the fastener 10 may commence.

FIG. 1 shows the fastener 10 as pressurized fluid is introduced into the fluid pressure chamber 50. In operation, the installation tool 90 preferably delivers a preset, high-pressure, volume of air to the fastener 10. Pressurized air is provided from the installation tool 90 and enters the fastener 10 between the plunger button 88 and the wall of the piston upper bore 60. The pressurized air acts upon the plunger 80 to force it downwardly so as to depress the check valve body 70 thereby permitting access to the fluid pressure chamber 50. The pressurized air travels between the plunger 80 and the walls of the upper bore 60, through the connecting bore 64, and past the check valve assembly 68 into the fluid pressure chamber 50.

As pressurized air continues to be forced into the fastener 10, the pressure within the fluid pressure chamber 50 increases and provides a force that acts upon the piston face 92 and forces the piston 16 outwardly relative to the housing 12. Because the fluid pressure chamber 50 is defined by the sidewalls of the upper housing portion 24, a base wall 95 having an fluid-tight seal 46 surrounding the shaft 44, and piston face 92, piston 16 will move axially outwardly within the housing 12 in response to the introduction of pressurized air.

As the piston 16 is forced outwardly, flanges 94 engage the shaft head 45 and force the piston assembly 22 to move in a corresponding fashion. Therefore, as air pressure forces the piston 16 to move axially outwardly relative to the housing 12, the fingers 18 are retracted over the spreader member 14 and into the housing 12. As the fingers 18 are withdrawn within the fastener housing as shown in FIG. 2, the spreader member 14 forces the fingers 18 to move apart. This permits the protuberances 36 to engage the inner surface 38 of the inner workpiece 32 so the fingers 18 cannot be withdrawn therefrom and secure the workpieces 30,32 between the housing 12 and the finger proturberances 36.

Fingers 18 will continue to retract within the housing 12 until air is no longer forced into the pressure chamber 50. Preferably, the installation tool 90 will deliver a specific volume of air to the fastener 10 and therefore provide a known amount of fastening force. Once the specific volume of air is forced into the fluid pressure chamber 50, no force acts upon the plunger 80 to keep the check valve assembly 68 open. Therefore, compressed spring 72 urges the check valve body 72 upwardly and seals the fluid pressure chamber 50 so as to maintain the pressure therein and fingers 18 in their position of retraction.

Thus, a volume of air acts on the piston 16 to draw the fingers 18 over the spreader member 14 to create a clamping on workpieces 30,32. Once engaged, the piston 16 continues to draw the fingers 18, thus clamping the workpieces 30,32 until the fingers cannot travel any further. This action generates a drawing force (the net force acting on the fingers while the installation tool is affixed to the fastener) proportionate to the air pressure and the net piston area. At that time the whole system air pressure is equal and the check valve closes as shown in FIG. 2 and the tool is removed. (The net piston area is the area of the piston face 92 minus the area of the installation tool high-pressure air inlet.) The clamping force is sustained until the air pressure is relieved.

As temporary fasteners are typically set and left for periods of time, the fastener 10 is likely to be set by the installation tool 90 and the tool removed to install a temporary fastener at another position. However, because the fastener of the present invention can hold its pressure, the fastener can maintain its clamping force on the workpieces.

An instant load-release feature is included in the fastener design to provide means-for manual or automated release of the fluid pressure within the fluid pressure chamber 50 and subsequent removal of the fastener 10. Release of the clamping force and removal of the fastener 10 is accomplished by the release of the pressurized air from within the fluid pressure chamber 50. This is accomplished by depressing the plunger button 88 which forces the plunger tip 86 to depress the check valve body 70 downwardly against the force of the spring 72. Thus, with the check valve body 70 no longer creating an fluid-tight seal within the bottom bore 62 of the piston 16, pressurized air is permitted to escape the fluid pressure chamber 50 and exit the fastener 10 between the plunger 80 and the walls of the inner piston bore 60. Continued force on the end of the plunger 80 will move the piston assembly back to its start position where the distal ends of the fingers 18 are bias together and the fingers 18 can be easily withdrawn from the workpiece apertures and reused.

The invention has been described with reference to the preferred embodiment. Obviously, modifications and alternations will occur to others upon a reading and understanding of this specification. The claims as follows are intended to include all modifications and alterations insofar as they come within the scope of the claims or the equivalents thereof.

Having thus described the invention, I claim:

1. A temporary fastener for urging a plurality of workpieces together through aligned apertures in the workpieces, said temporary fastener comprising:

a housing having an axial bore therethrough;

a spreader member connected to said housing transverse to said axial bore;

a piston located within said housing and capable of movement therein in response to the introduction of pressurized fluid within said housing;

at least one pair of expandable flexible fingers connected at one end to said piston and extending outside said housing, said spreader member located between said fingers, and wherein movement of said piston causes said fingers to partially retract within said housing and causes said fingers to wedgingly engage said aligned apertures; and a check valve that permits introduction of pressurized fluid into said housing and prevents fluid release therefrom, wherein said check valve is located within said piston.

2. The temporary fastener of claim 1 further comprising mutually opposed protuberances extending from said fingers so that when said fingers are retracted and said spreader member wedges therebetween, said fingers cannot be withdrawn from said apertures.

3. The temporary fastener of claim 2 further comprising a plunger located within said piston and accessible wherein depression of said plunger disengages said check valve thereby permitting the release of fluid from within said housing.

4. The temporary fastener of claim 3 wherein said pressurized fluid is a pressurized liquid.

5. The temporary fastener of claim 3 wherein said pressurized fluid is a pressurized gas.

6. The temporary fastener of claim 5 wherein said pressurized gas is pressurized air.

7. A temporary fastener for urging a plurality of workpieces together through aligned apertures in the workpieces, said temporary fastener comprising:

a housing having an inner end and an outer end and an axial opening therethrough;

a piston located within said opening and moveable therein in response to the introduction of fluid pressure;

a pair of expandable flexible fingers having an outer end connected to said piston and an inner end extending beyond the inner end of said housing, said inner end of each said finger including a protuberance extending outwardly therefrom and being biased toward each other to permit insertion of said fingers through the aligned apertures of a plurality of workpieces;

a spreader member connected to said housing and located between said fingers wherein retraction of said piston within said housing draws said fingers over said spreader member thereby wedging the inner ends of said fingers apart so that said fingers wedgingly engage said aligned apertures and said protrusions of said fingers cannot be withdrawn from said openings; and a check valve that permits the introduction of fluid pressure into said housing and prevents fluid pressure release therefrom, wherein said check valve is located within said piston.

8. The temporary fastener of claim 7 further comprising a plunger located within said piston and accessible wherein depression of said plunger disengages said check valve thereby permitting the release of fluid pressure from within said housing.

9. A temporary fastener for urging a plurality of workpieces together through aligned apertures in the workpieces, said temporary fastener comprising:

a housing having an inner end and an outer end and an axial opening therethrough;

a shaft extending axially within said housing;

a fluid pressure chamber located within the opening of said housing defined by:

a sealing member located between said shaft and said housing; and a piston located within said opening outwardly of said sealing member and connected to said shaft;

means for introducing fluid into said fluid pressure chamber wherein said piston is urged outwardly in response thereto, wherein said means for introducing fluid is located within said piston;

at least one pair of expandable flexible fingers having an outer end connected to said shaft and an inner end extending beyond the inner end of said housing, said inner end of each said finger including a protrusion extending outwardly therefrom and being biased toward each other to permit insertion of said fingers through the aligned apertures of a plurality of workpieces; and a spreader member connected to said housing and located between said fingers wherein retraction of said piston within said housing draws said fingers over said spreader member thereby wedging the inner ends of said fingers apart so that said protrusions engage the inner surface of the inner workpiece and so said fingers wedgingly engage said aligned apertures to wedge said workpieces together.

10. The temporary fastener of claim 9 wherein said piston includes a means for retaining said fluid pressure within said fluid pressure chamber so that said fingers may maintain a clamping force on said workpieces.

11. The temporary fastener of claim 10 wherein said piston includes a means for releasing said fluid pressure from within said fluid pressure chamber so that said clamping force may be released and said fingers extended outwardly from said housing and removed from within said aligned apertures.

12. A method of temporarily fastening a plurality of workpieces together through aligned apertures in the workpieces, the steps of said method comprising:

providing a temporary fastener having at least one pair of expandable flexible fingers connected at one end to a piston within the fastener housing and capable of movement in response to the introduction of pressurized fluid therein;

inserting the fingers into aligned apertures in a plurality of workpieces; and using a check valve to introduce a pressurized fluid within the fastener housing that forces the piston to move outwardly within the fastener housing and thus draws the fingers into the housing and over the spreader member to wedge the fingers apart until said fingers wedgingly engage the aligned apertures and thus provide a clamping force within the apertures of the workpieces, wherein said check valve is located within said piston.

13. The method of claim 12 wherein said pressurized fluid is a pressurized liquid.

14. The method of claim 12 wherein said pressurized fluid is a pressurized gas.

15. The method of claim 14 wherein said pressurized gas is pressurized air.

* * * * *